US005941310A

United States Patent [19]

Cunningham et al.

[11] Patent Number: 5,941,310

[45] Date of Patent: Aug. 24, 1999

[54] MONOBORE COMPLETION/ INTERVENTION RISER SYSTEM

[75] Inventors: Christopher E. Cunningham, Spring; Bradley D. Beitler, Houston, both of Tex.

[73] Assignee: FMC Corporation, Chicago, Ill.

[21] Appl. No.: 09/038,747

[22] Filed: Mar. 11, 1998

Related U.S. Application Data

[62] Division of application No. 08/622,541, Mar. 25, 1996, Pat. No. 5,819,852.

[51] Int. Cl.[6] ..... E21B 43/013

[52] U.S. Cl. ..... 166/345; 166/368

[58] Field of Search ..... 166/368, 70, 85.1, 166/85.5, 97.5, 345, 348, 367, 359

[56] References Cited

U.S. PATENT DOCUMENTS

| | | | |
|---|---|---|---|
| 3,545,541 | 12/1970 | DeVries | 166/95 |
| 4,632,188 | 12/1986 | Schuh et al. | 166/386 |
| 5,129,459 | 7/1992 | Breese et al. | 166/339 |
| 5,161,620 | 11/1992 | Ritter, Jr. | 166/368 |
| 5,377,762 | 1/1995 | Turner | 166/339 |
| 5,544,707 | 8/1996 | Hopper et al. | 166/382 |

*Primary Examiner*—Hoang C. Dang
*Attorney, Agent, or Firm*—Bush, Riddle & Jackson, L.L.P.

[57] ABSTRACT

A monobore completion/intervention riser system for providing a conduit for communication fluids and wireline tools between a surface vessel and a subsea well having a tubing hanger located therein, the tubing hanger including a production bore and an annulus bore, wherein wireline tools may be lowered through a riser bore 48 to either the tubing hanger production bore 68 or the tubing hanger annulus bore 70 through operation of a bore selector 56, and fluids may be produced from the well to the surface vessel through the production bore 52, 60, 64, 68 and the riser bore 48 by sealing off the annulus bore 66, 70.

7 Claims, 5 Drawing Sheets

MONOBORE COMPLETION/ INTERVENTION RISER SYSTEM

This application is a divisional of application Ser. No. 08/622,541 filed on Mar. 25, 1996 now U.S. Pat. No. 5,819,852.

BACKGROUND OF THE INVENTION

1. Field of the Invention

The present invention relates to a riser system which is used in subsea well completion and intervention operations to, among other things, provide a tubular conduit between the offshore drilling/intervention vessel and the subsea well. More particularly, the invention relates to a monobore riser system which is capable of providing selective communication between the surface vessel and the production and annulus bores within the wellhead.

2. Description of the Related Art

Riser systems are used in subsea well completion and intervention operations for installing, retrieving and intervening tubing hanger/completion strings and subsea xmas trees. Riser systems for conventional subsea completions comprise two tubular, typically steel conduits extending between the offshore drilling or intervention vessel and the subsea equipment. Simpler monobore casing risers, which are different from the subject invention, are typically used for horizontal xmas tree applications. These conduits represent the structural portion of the riser system and also allow for the transfer of fluids and wireline tools between the vessel and the production and annulus bores in the wellhead. Riser systems also include one or more controls umbilicals, which are typically a bundle of hydraulic hoses and electrical cables which transfer hydraulic and electrical power and control signals between the vessel and the subsea equipment in order to facilitate control of the subsea equipment from the surface. The combination of the structural riser conduits and umbilicals, and the specialty equipment related to each, is typically referred to as a completion/intervention (C/IR) riser system.

The prior art dual-bore riser systems employ two tubular conduits in one configuration or another, with each conduit providing direct communication between the surface vessel and either the production bore or the annulus bore within the wellhead. One riser configuration comprises pre-unitized joints of side-by-side production bore tubing and annulus bore tubing locked together by clamping elements. The bulk of the riser string is made up of typically 45 to 50 foot (and sometimes longer) lengths of these joints, although additional pup joints of varying shorter lengths are usually needed to adjust the final space-out between the surface vessel and the subsea equipment. The clamping elements provide the additional capability of securing the umbilicals to the conduits. Other riser configurations include individual strings of production bore and annulus bore tubing and various cased multibore and concentric bore designs.

The C/IR system may be used inside a conventional marine drilling riser or in an open sea environment. In the latter case, the riser may be deployed from an anchored or dynamically-positioned drilling rig or, alternatively, from a lighter weight, typically dynamically-positioned, service vessel. When used in the open sea environment, substantial loads are imposed on the riser and its deploying vessel. Consequently, the riser system should include a riser safety package (RSP) and an emergency disconnect package (EDP) to terminate the lower end of the riser and provide the necessary well control and safety features. Horizontal xmas trees do not normally require an "open sea" riser application except for the "light weight intervention" scenario. The subject invention provides the same benefits for horizontal xmas trees and conventional xmas trees under these circumstances (most notably in the area of annulus conduits).

Because the lighter-weight service vessels do not usually have the same storage and load-carrying capacity as drilling rigs, current C/IR systems cannot readily or practically be deployed from these vessels. Furthermore, even conventional drilling rigs are limited in their ability to deploy some riser systems effectively in very deep water applications because string weight can be a problem for tubing hanger landing and orientation operations. Also, as the water depth in which subsea wells are completed increases, both the capital and operating expenses associated with the riser system are likely to increase because more riser will be required and that riser will be exposed to greater forces, factors which will likely drive up the size and cost of the structural conduits, umbilicals and other components of the riser system.

SUMMARY OF THE INVENTION

Therefore, it is an object of the present invention to provide a completion/intervention riser system which is simpler in construction, lighter and easier to deploy than the above-mentioned riser systems, but which nevertheless is capable of providing the necessary fluid and wireline/coiled tubing communication between the surface vessel and the production and annulus bores in a well. It is a further object of the invention to provide such a riser system which is suitable for deep water applications.

According to the present invention, these and other objects and advantages are achieved by providing a completion/intervention riser system which comprises a string of single-bore, or monobore, riser conduit extending substantially between the surface vessel and the subsea well and a branch-off section (conventional xmas tree applications only) connected to the lower end of the riser conduit for establishing communication between the monobore riser conduit and both the production and annulus bores in the wellhead, as will be described below. The branch-off section includes a production bore in direct communication with the riser conduit, an annulus bore which branches off of the production bore, a bore selector for selectively closing either the production bore or the annulus bore and a retainer valve for selectively sealing off the riser bore above the bore selector.

In xmas tree applications, the riser system of the present invention also comprises an emergency disconnect package (EDP) located below the branch-off section and a riser safety package (RSP) connected between the EDP and the tree running tool (TRT) attached to the top of the xmas tree. The EDP and the RSP include production and annulus bores extending between the production and annulus bores in the branch-off section and the production and annulus bores in the xmas tree, which are in turn in communication with the production and annulus bores in the wellhead. The RSP includes a crossover conduit connecting the production bore and the annulus bore, a crossover valve for selectively closing the crossover conduit, an annulus isolation valve for selectively sealing off the annulus bore above where the crossover conduit intersects the annulus bore, a grip and seal tubing ram located in the production bore above where the crossover conduit intersects the production bore, a blind ram located in the production bore below where the crossover conduit intersects the production bore, a second grip and seal tubing ram located in the production bore below the blind ram, a production bypass loop having one end intersecting the production bore above the upper grip and seal tubing ram and the other end intersecting the production bore below the lower grip and seal tubing ram, and a production bypass valve for selectively sealing off the production bypass loop. The riser system may also comprise a relatively small diameter annulus vent line connected to the annulus bore in, for example, the RSP and extending to the surface vessel within the controls umbilical.

In tubing hanger applications, the riser system of the present invention is designed to be deployed inside a marine riser which terminates in a blow-out preventer (BOP) stack. In this application, the riser system comprises, in addition to the monobore riser conduit and branch-off section, an EDP similar to the EDP described above but sized appropriately to fit within the bore of the BOP stack, a dual bore subsea test tree (SSTT) safety package connected below the EDP and a tubing hanger orientation joint (THOJ) connected between the dual bore SSTT safety package and the tubing hanger running tool (THRT). The EDP, dual bore SSTT safety package and THOJ include production and annulus bores extending between the production and annulus bores in the branch-off section and the production and annulus bores in the THRT, which are in turn in communication with the production and annulus bores in the wellhead. The dual bore SSTT safety package includes an annulus circulation valve for selectively sealing off the annulus bore from communication with the production bore. The THOJ comprises a ram spool and an annulus side outlet for providing access to the choke and kill facilities of the BOP stack, which include choke and kill lines extending to the surface vessel and choke and kill valves for selectively closing each choke and kill line.

The riser system of the present invention also comprises a main control unit for controlling the operation of the riser system components from the surface vessel. The main control unit is located on the surface vessel and includes a series of electrical and hydraulic controls which are connected to the riser system components, such as the bore selector, the rams and the valves, through one or more controls umbilicals. Thus, the riser system components may be operated remotely by an individual located on the surface vessel. In addition, the main control unit can be programmed so that individual system components may be operated simultaneously or in a controlled sequence, depending on the particular operation being undertaken.

Although the present invention employs a monobore riser conduit, the required transfer of fluids and wireline tools between the vessel and the production and annulus bores in the wellhead can be accomplished through selective operation of the riser system components. In either xmas tree or tubing hanger applications, wireline tools can be run down the riser conduit and directed to either the production bore or the annulus bore by the bore selector located in the branch-off section. In xmas tree applications, production fluids such as oil or gas can be communicated to the surface vessel through the monobore riser conduit by closing the annulus isolation and crossover valves. In this situation, the annulus may be vented through the annulus vent line in the umbilical, or the production bore can be sealed off by the blind ram and the annulus vented through the annulus isolation valve into the monobore riser conduit. In tubing hanger applications, fluids can be communicated to the surface by opening the production cut and seal valves while the annulus circulation valve is closed. In this situation, the annulus is vented to the surface through the choke and kill line by closing the BOP rams and opening the choke and kill valve.

According to the present invention, in the event that a circulation path needs to be established between the well and the surface vessel in xmas tree applications, coiled tubing or "spaghetti string" can be deployed from the surface vessel down through the monobore riser conduit. For example, in preparation for a controlled disconnect of the riser in a xmas tree application, the blind ram is closed and coiled tubing is run down the monobore riser until it tags the blind ram. With the production bypass, crossover and annulus isolation valves closed, fluid pumped down the coiled tubing is directed up the annular space between the tubing and monobore riser conduits to clear the riser of production fluids prior to the disconnect. Similarly, through the selective operation of the riser system components in both xmas tree and tubing hanger applications, all required circulation paths between the surface vessel and the well may be established, as will be described in detail below.

Thus, the present invention provides a monobore riser system which is lighter, less expensive and easier to deploy than dual-bore systems but which is capable of performing every operation required of C/IR riser systems.

These and other objects and advantages of the present invention will be made apparent from the following detailed description, with reference to the accompanying drawings.

DETAILED DESCRIPTION OF THE PREFERRED EMBODIMENTS

Figure 1:
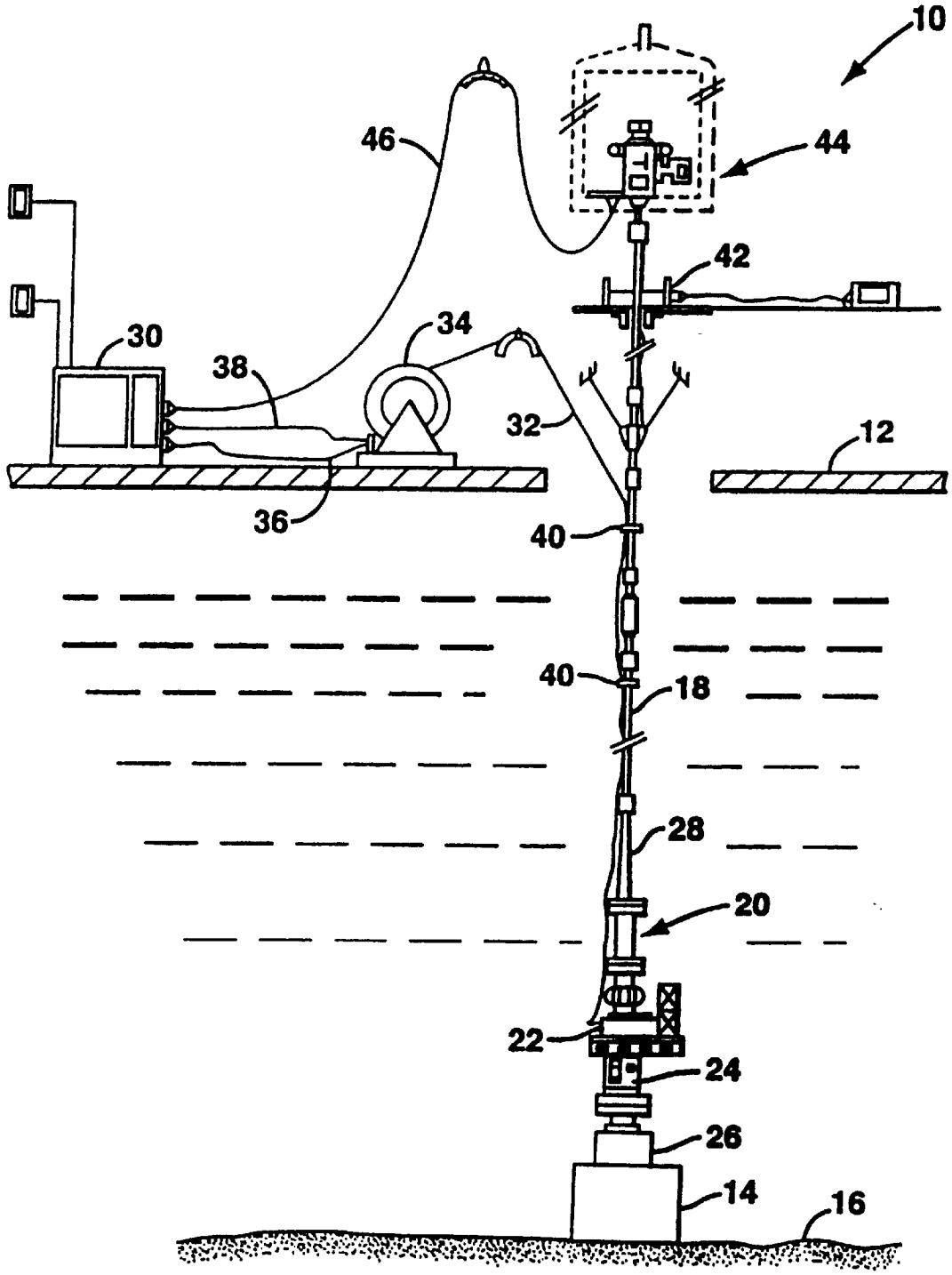
FIG. 1 is a schematic view of the present invention as adapted for use in a xmas tree application.

Referring to FIG. 1, an embodiment of the present invention is illustrated which is particularly suitable for use in connection with subsea xmas tree applications. In this embodiment, the inventive completion/intervention riser system 10 is shown extending between a surface vessel 12 and a subsea xmas tree 14 located on the subsea floor 16. For conventional xmas trees, as is understood by those in the art, xmas tree 14 is locked to a wellhead (not shown) from which is suspended a tubing hanger having a production bore in communication with the production tubing extending into the oil or gas well and an annulus bore in communication with the annulus between the production tubing and the surrounding casing string.

Riser system 10 comprises a string of single-bore (monobore) riser conduit 18 which extends substantially from surface vessel 12 to xmas tree 14. Monobore riser conduit 18 is constructed of individual joints of typically 45 to 50 foot lengths of preferably steel tubing joined together in a conventional manner; however, additional pup joints of varying shorter lengths may also be required to adjust the final space-out between surface vessel 12 and xmas tree 14. Riser system 10 also comprises a branch-off section 20 connected to the lower end of monobore riser conduit 18, an emergency disconnect package (EDP) 22 connected to the lower end of branch-off section 20, and a riser safety package (RSP) 24 connected between EDP 22 and a tree running tool (TRT) 26, which in turn is connected to the top of xmas tree 14. A tapered stress joint 28 may also be provided between the end of monobore riser conduit 18 and branch-off section 20 to increase the structural integrity of the riser system 10.

Riser system 10 also comprises a main control unit 30 located on surface vessel 12 for controlling the operation of the above-mentioned riser system components. Main control unit 30 includes a series of electrical and hydraulic controls which are connected to the riser system components through a main controls umbilical 32, which includes one or more electrical and hydraulic lines for communicating the electrical and hydraulic control signals to the riser system components. Main controls umbilical 32 is run out on a main umbilical reel 34, which is linked to main control unit 30 through a main umbilical jumper 36 and powered by a utilities jumper 38. Main controls umbilical 32 is preferably attached to monobore riser conduit 18 with a plurality of clamps 40. Thus, the riser system components may be operated remotely by an individual located on surface vessel 12. In addition, main control unit 30 can be programmed so that individual system components may be operated simultaneously or in a controlled sequence, depending on the particular operation being undertaken.

Riser system 10 also includes a conventional riser spider 42 for deploying monobore riser conduit 18 and the riser system components. The upper end of monobore riser conduit 18 is connected to a surface flow tree 44, which provides controlled access to monobore riser conduit 18 for communication of fluids and wireline/coiled tubing tools to the subsea and downhole equipment, as is fully understood by those skilled in the art. Surface flow tree 44 is controlled by the main control unit 30 through a surface tree jumper 46. The details of riser spider 42 and surface flow tree 44 are well understood by those skilled in the art and are not necessary to an understanding of the present invention.

Figure 2:
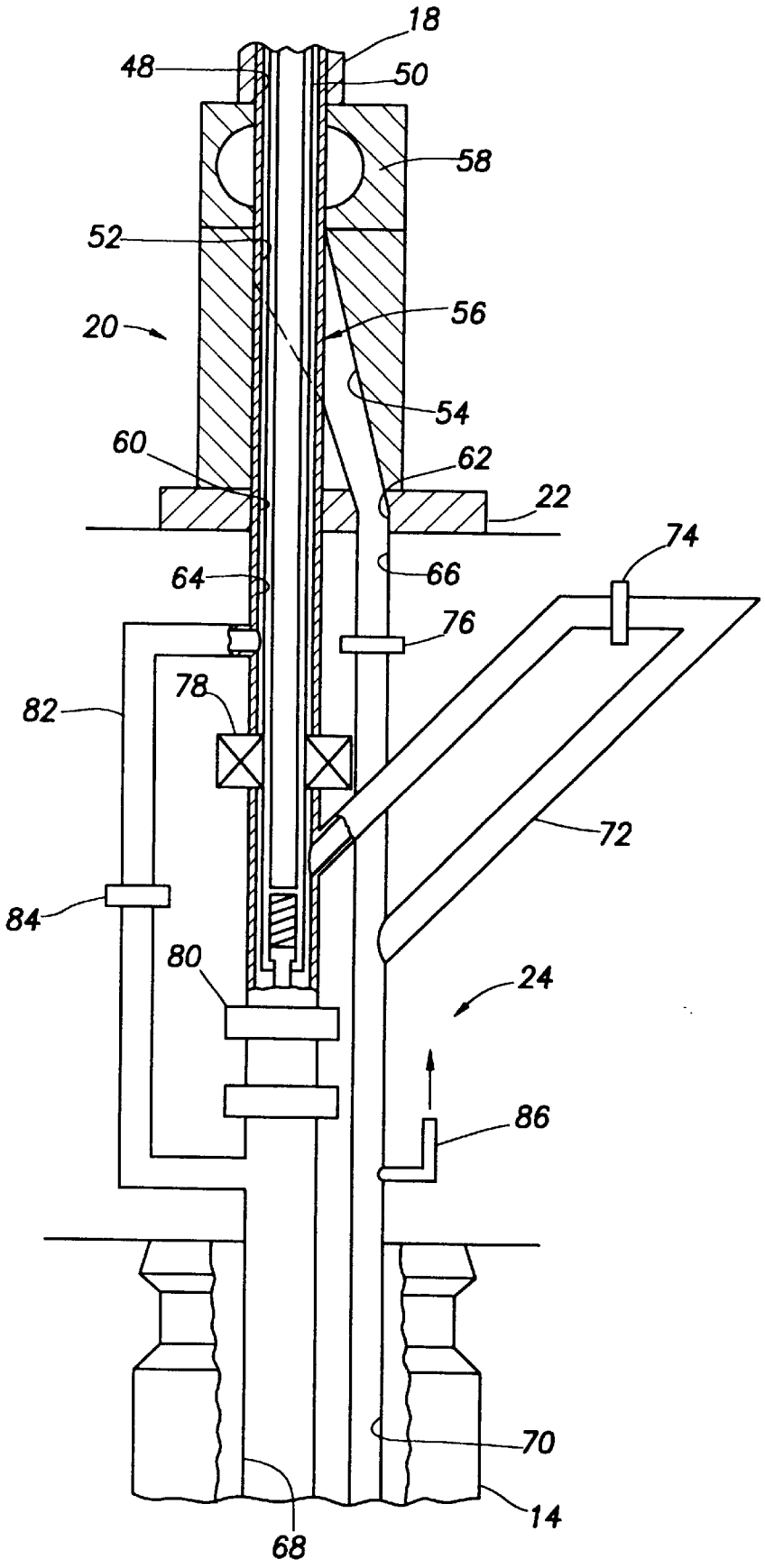
FIG. 2 is an enlarged schematic view of a portion of the invention depicted in FIG. 1.

Referring to FIG. 2, the lower end of monobore riser conduit 18 is shown connected to branch-off section 20. Monobore riser conduit 18 can be seen to comprise a single bore 48. A string of coiled tubing 50 or "spaghetti string" is shown extending through bore 48; however, in normal operation of riser system 10, coiled tubing 50 is not employed. The circumstances in which coiled tubing 50 are used will be described hereinafter.

Branch-off section 20 includes a production bore 52 in direct communication with bore 48 in riser conduit 18, an annulus bore 54 which branches off of production bore 52, a bore selector 56 for selectively closing either production bore 52 or annulus bore 54, and a retainer valve 58 for selectively sealing off the riser bore 52 above bore selector 56.

EDP 22 is connected to the lower end of branch-off section 20 and functions to disconnect monobore riser conduit 18 from riser safety package 24 in the event of an emergency in a manner understood by those skilled in the art. EDP 22 comprises a production bore 60 and an annulus bore 62 which are in communication with production bore 52 and annulus bore 54, respectively, in branch-off section 20.

As shown in FIG. 1, RSP 24 incorporates the TRT 26 and is connected between EDP 22 and the top of xmas tree 14. RSP 24 includes a production bore 64 and an annulus bore 66 in communication with production bore 60 and annulus bore 62, respectively, in EDP 22. Production bore 64 and annulus bore 66 are also in communication with the production bore 68 and the annulus bore 70 in xmas tree 14, which are in turn in communication with the production and annulus bores in the wellhead. Hereinafter, production bores 52, 60, 64 and 68 running through branch-off section 20, EDP 22, RSP 24 and xmas tree 14, respectively, may sometimes simply be referred to as the production bore, and annulus bores 54, 62, 66 and 70 running through branch-off section 20, EDP 22, RSP 24 and xmas tree 14, respectively, may sometimes be referred to as the annulus bore. Oil and/or gas may be transported from the well to surface vessel 12 through the production bore and monobore riser conduit 18 by closing annulus isolation valve 76 and crossover valve 74. In this operation, the annulus is vented to the surface through annulus vent line 86. Alternatively, if larger volume is required, the annulus may be vented by closing blind ram 80 and production bypass valve 84 to seal off the production bore and opening annulus isolation valve 76. In this case, the annulus is vented through monobore riser 18 and annulus vent line 86 is not required.

In order to prepare for a controlled disconnect of riser system 10 from xmas tree 14 (assuming the riser needs to be flushed clean), coiled tubing or "spaghetti string" 50 having a preferred diameter of approximately 2 to 3 inches is employed to circulate production fluids out of monobore riser conduit 18. In this operation, crossover valve 74, annulus isolation valve 76 and blind ram 80 are all closed and tubing 50 is run down through bore 48 in monobore riser 18 until it tags blind ram 80. Circulation fluid, such as sea water, is then pumped down tubing 50 and is directed back up the annulus between bore 48 and tubing 50 by blind ram 80 to thereby clear monobore riser 18 of production fluids. Alternatively, grip and seal tubing ram 78 may be closed around tubing 50 to hold it in place. In this case, appropriate valves in xmas tree 14 are closed and crossover valve 74 and annulus isolation valve 76 both opened. Thus, circulation fluid pumped down tubing 50 will be directed through crossover conduit 72, up the annulus bore and into the annulus between bore 48 and tubing 50 to thereby clear monobore riser 18 of production fluids.

Tubing 50 is also employed to clear monobore riser conduit 18 of production fluids after an emergency disconnect separating riser conduit 18 from RSP 24 has been performed. In an emergency disconnect operation, retainer valve 58 and typically all the valves in RSP 24 are closed. Tubing 50 is then run down through bore 48 in monobore riser 18 until it tags retainer valve 58. Circulation fluid is then pumped down tubing 50 and directed by retainer valve 58 back up the annulus between bore 48 and tubing 50 to thereby clear monobore riser 18 of production fluids.

Tubing 50 is also used when it is desired to circulate fluids between surface vessel 12 and the well. In this operation, annulus isolation valve 76 and blind ram 80 are closed, tubing 50 is run down bore 48 until it tags blind ram 80, and grip and seal tubing ram 78 is closed around tubing 50. In addition, crossover valve 74 and production bypass valve 84 are opened, as is the downhole sliding sleeve, for example (not shown) separating the production bore from the annulus bore within the well. A path is thus established down tubing 50, through crossover conduit 72, down the annulus bore into the well, up the production bore, through production bypass loop 82 and back to surface vessel 12 through the annulus between bore 48 and tubing 50. This path may of course be reversed, if required, and other paths may be established through selective operation of the riser system components.

Figure 3:
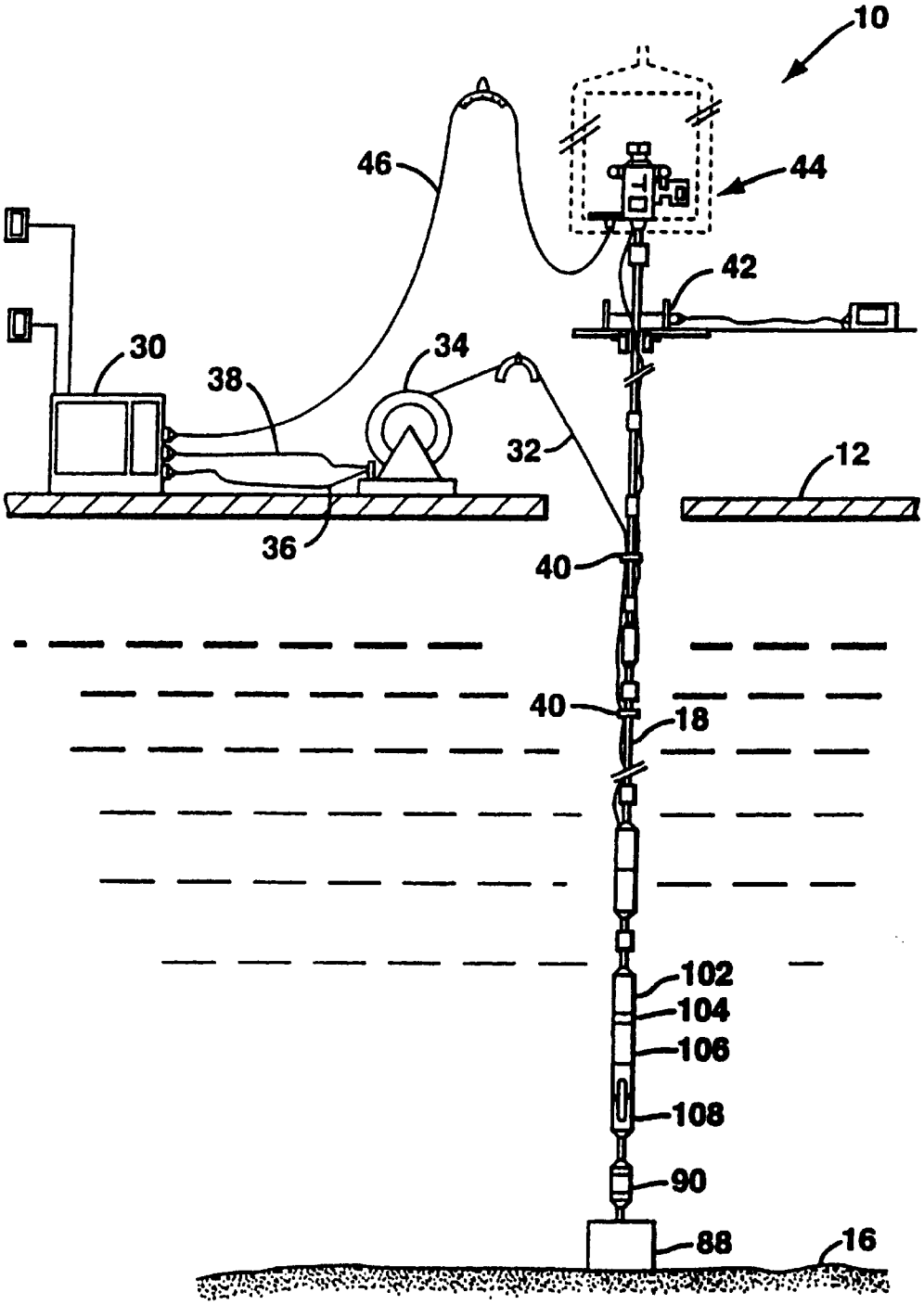
FIG. 3 is a schematic view of the present invention as adapted for use in a tubing hanger application.

Referring to FIG. 3, a second embodiment of the present invention is illustrated which is particularly suitable for use in connection with subsea tubing hanger applications. In describing this embodiment, the same reference numbers will be used to refer to components described in the previous embodiment. In this embodiment, the inventive completion/intervention riser system 10 is shown extending between surface vessel 12 and a subsea wellhead 88 extending into the subsea floor 16. For tubing hanger interface applications, a subsea BOP stack and marine riser will be attached to the wellhead, the monobore riser equipment which run thereinto. As more clearly illustrated in FIG. 4, riser system 10 terminates in a tubing hanger running tool (THRT) 90 which is connected to a tubing hanger 92 suspended in wellhead 88. Tubing hanger 92 includes a production bore 94 in communication with the production tubing 96 extending into the well and an annulus bore 98 in communication with the annulus between production tubing 96 and the surrounding casing string 100.

As in the previous embodiment, riser system 10 comprises a string of single-bore, or monobore, riser conduit 18 which extends substantially from surface vessel 12 to wellhead 88. Riser system 10 also comprises a branch-off section 102 connected near the lower end of monobore riser conduit 18, an emergency disconnect package (EDP) 104 connected to the lower end of branch-off section 102, a dual bore subsea test tree (SSTT) safety package 106 connected below EDP 104, and a tubing hanger orientation joint (THOJ) 108 connected between the dual bore SSTT safety package 106 and THRT 90. On occasion, it may be desirable to integrate the SSTT and THRT functions into a single component. The riser system 10 of this embodiment also includes the main control unit 30 and the associated features described with reference to the previous embodiment for controlling the operation of the riser system components.

Figure 4:
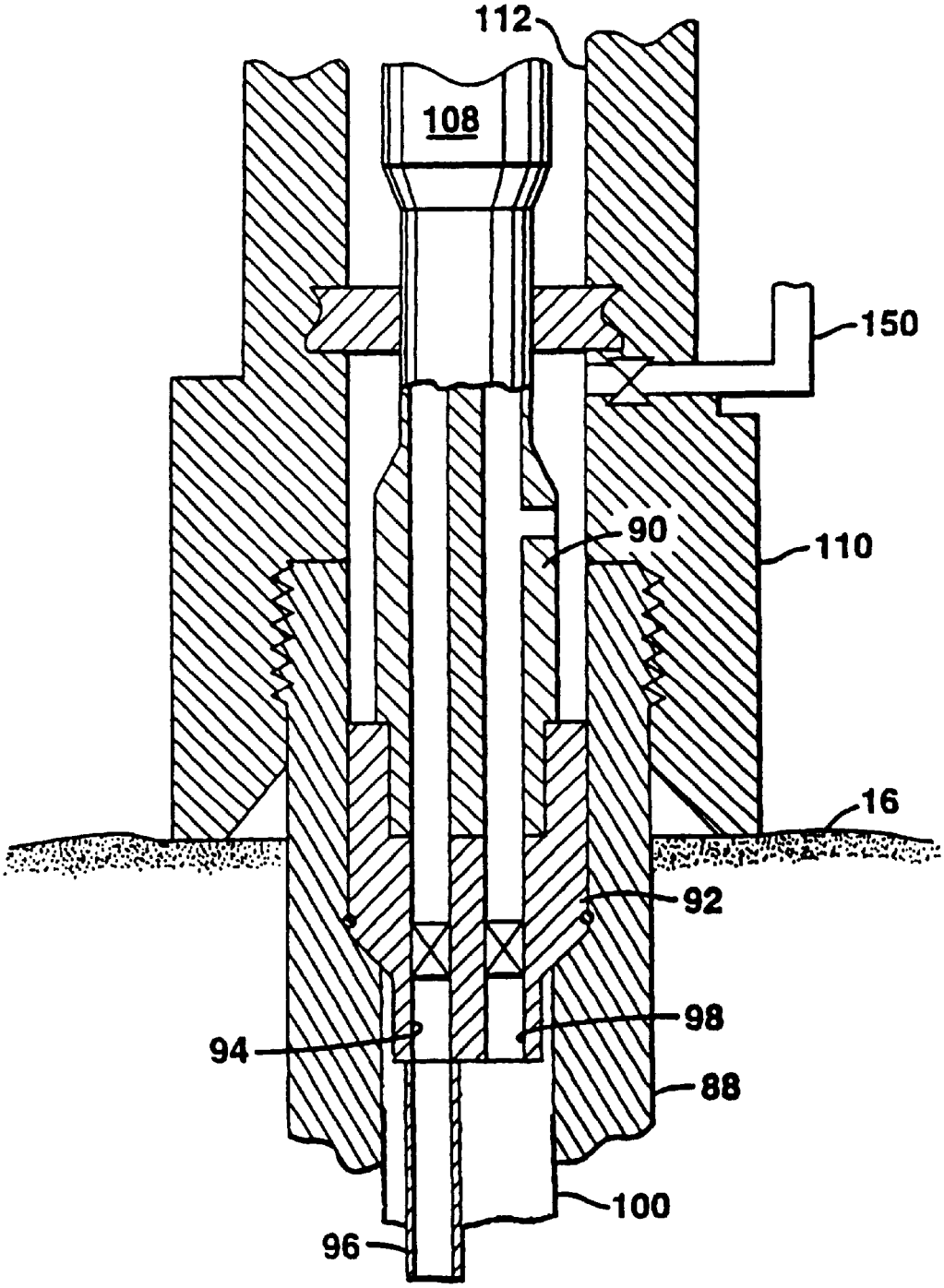
FIG. 4 is a cross-sectional view of a portion of the invention depicted in FIGS. 3.
Figure 5:
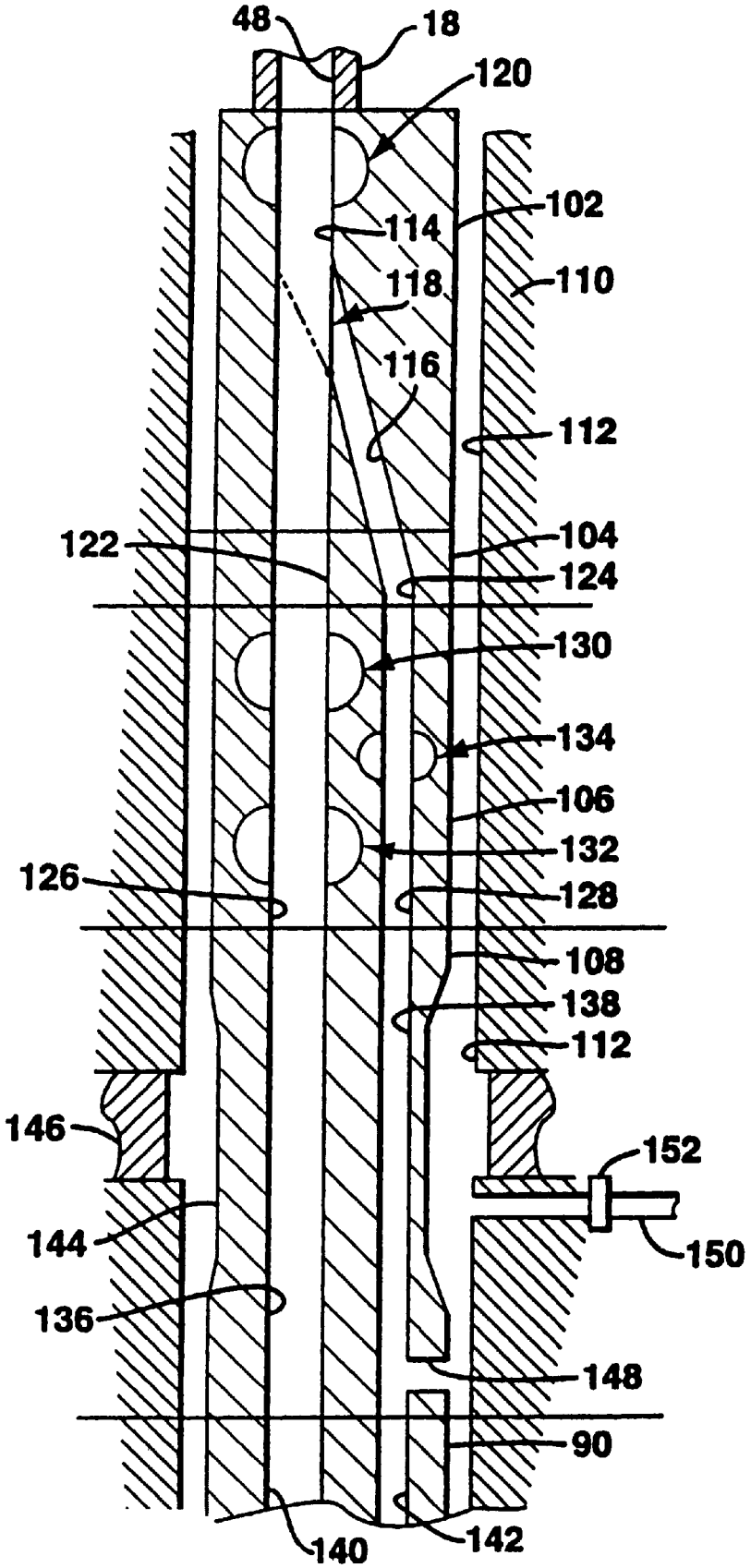
FIG. 5 is an enlarged schematic view of a portion of the invention depicted in FIG. 3.

Referring to FIGS. 4 and 5, riser system 10 of the present embodiment is deployed inside a conventional marine riser (not shown) which terminates in a blow-out preventer (BOP) stack 110 connected to wellhead 88. Thus, riser system 10 extends through a bore 112 formed in BOP stack 110.

Branch-off section 102 includes a production bore 114 in direct communication with bore 48 in riser conduit 18, an annulus bore 116 which branches off of production bore 114, a bore selector 118 for selectively closing either production bore 114 or annulus bore 116, and a retainer valve 120 for selectively sealing off production bore 114 above bore selector 118.

EDP 104 is connected to the lower end of branch-off section 102 and functions to disconnect monobore riser conduit 18 from tubing hanger 92 in the event of an emergency. EDP 104 comprises a production bore 122 and an annulus bore 124 which are in communication with production bore 114 and annulus bore 116, respectively, in branch-off section 102.

Dual bore SSTT safety package 106 comprises a production bore 126 and an annulus bore 128 in communication with the production bore 122 and annulus bore 124 in EDP 104. In addition, dual bore SSTT safety package 106 includes an upper production cut typically and seal valve 130 and a lower production cut and seal valve 132, both located in production bore 126, and an annulus circulation valve 134 located in the annulus bore 128. Production cut and seal valves 130 and 132 and annulus circulation valve 134 serve to selectively close off production bore 126 and annulus bore 128, respectively.

THOJ 108 comprises a production bore 136 and an annulus bore 138 extending between production bore 126 and annulus bore 128, respectively, in dual bore SSTT safety package 106 and a production bore 140 and annulus bore 142 in THRT 90, which in turn are in communication with production bore 94 and annulus bore 98 in tubing hanger 92. Hereinafter, production bores 114, 122, 126, 136 and 140 may sometimes simply be referred to as the production bore, and annulus bores 116, 124, 128, 138 and 142 may sometimes simply be referred to as the annulus bore. THOJ 108 further comprises typically a ram spool 144, which can be sealingly engaged by BOP rams 146 located in BOP stack 110, and an annulus side outlet 148, which provides communication between the annulus bore and bore 112 within BOP stack 110. A choke and kill conduit 150 extends between bore 112 and the surface vessel 12, and a choke and kill valve 152 allows choke and kill conduit 150 to be selectively opened or closed.

In operation of the embodiment of riser system 10 depicted in FIGS. 3–5, wireline tools may be run down monobore riser conduit 18 and directed into either the production bore or the annulus bore through selective operation of bore selector 118. Furthermore, oil or gas may be communicated from the well to surface vessel 12 through the production bore and monobore riser conduit 18 by opening production cut and seal valves 130 and 132 and closing annulus circulation valve 134 and BOP rams 146. In this operation, choke and kill valve 152 is opened and the annulus fluids are vented through annulus side outlet 148 and up choke and kill conduit 150. The annulus side outlet may be equipped with an isolation valve/sleeve.

In order to prepare for a controlled disconnect of riser system 10 from tubing hanger 92, choke and kill conduit 150 is employed to circulate production fluids out of monobore riser conduit 18. In this operation, annulus circulation valve 134 is opened, BOP rams 146 are closed, production bore 94 and annulus bore 98 in tubing hanger 92 are plugged using conventional means and the production valves are closed. Circulation fluid is then pumped down choke and kill conduit 150 and is directed through annulus side outlet 148, up through the annulus and into bore 48 to thereby clear monobore riser 18 of production fluids.

Choke and kill conduit 150 is also used when it is desired to circulate fluids between surface vessel 12 and the well. In this operation, annulus circulation valve 134 and BOP rams 146 are closed, and the down hole sliding sleeve, for example (not shown), separating the production bore from the annulus bore within the wellhead (not shown) is opened. A path is thus established down choke and kill conduit 150, through annulus side outlet 148, down the annulus bore into the well, up the production bore and back to surface vessel 12 through bore 48 in monobore riser conduit 18. This path may of course be reversed, if required, and other paths may be established through selective operation of the riser system components.

In the event of an emergency disconnect operation separating monobore riser conduit 18 from dual bore SSTT safety package 106, coiled tubing/"spaghetti string" 50 is employed to clear monobore riser conduit 18 of production fluids. In this operation, retainer valve 120 and all the valves in dual bore SSTT safety package 106 are closed. Tubing 50 is then run down through bore 48 in monobore riser 18 until it tags retainer valve 120. Circulation fluid is then pumped down tubing 50 and directed by retainer valve 120 back up the annulus between bore 48 and tubing 50 to thereby clear monobore riser 18 of production fluids.

It should be recognized that, while the present invention has been described in relation to the preferred embodiments thereof, those skilled in the art may develop a wide variation of structural details (including applications for horizontal xmas trees) without departing from the principles of the invention. Therefore, the appended claims are to be construed to cover all equivalents falling within the true scope and spirit of the invention.

What is claimed is:

1. In combination with a subsea well head, landing means for landing a tubing hanger carried by said well head, a tubing hanger having an annulus bore and a production bore and landed in said landing means, and a subsea xmas tree having an annulus bore and a production bore which communicate with said annulus bore and said production bore of said tubing hanger, a completion/intervention/riser arrangement comprising, a Riser Safety Package (RSP) having a production bore and an annulus bore which extend from a top end of said RSP to a bottom end of said RSP with said bottom end of said RSP coupled to said subsea xmas tree and with said RSP production bore and annulus bore being in communication with said xmas tree production bore and annulus bore, an Emergency Disconnect Package (EDP) having a bottom end and a top end, with said bottom end of said EDP coupled to said top end of said RSP, said EDP including a bore selector having a production bore and an annulus bore which extend through said bottom end of said EDP and which are in fluid communication with said production bore and said annulus bore of said RSP, said production bore and said annulus bore of said selector forming a juncture with a single bore which extends to a top end of said bore selector, said bore selector having a selectively operable selector device at said juncture for selectively closing off either the selector production bore or the selector annulus bore, a monobore riser conduit extending from a surface vessel to said single bore of said bore selector, said RSP including a crossover conduit with a remotely operable crossover valve therein, said crossover conduit connected between said RSP production bore at a crossover production point and said RSP package annulus bore at a crossover annulus point, a remotely operable annulus isolation valve disposed in said RSP annulus bore, an annulus vent line connected to a RSP annulus bore below said annulus isolation valve, and wherein, said annulus isolation valve is closed in said RSP annulus bore, and said crossover valve in said crossover conduit is closed, whereby, production fluid can be produced via said production bore of said RSP and said EDP and said monobore riser conduit to said surface vessel and said annulus can be vented to the surface via said annulus vent line.

2. In combination with a subsea well head, landing means for landing a tubing hanger carried by said well head, a tubing hanger in said well head having an annulus bore and a production bore and landed in said landing means, and a subsea xmas tree having an annulus bore and a production bore which communicate with said annulus bore and said production bore of said tubing hanger, a completion/intervention/riser arrangement comprising, a Riser Safety Package (RSP) having a production bore and an annulus bore which extend from a top end of said RSP to a bottom end of said RSP with said bottom end of said RSP coupled to said subsea xmas tree with said RSP production bore and annulus bore being in communication with said xmas tree production bore and annulus bore, an Emergency Disconnect Package (EDP) having a bottom end and a top end, with said bottom end of said EDP coupled to said top end of said RSP, said EDP including a bore selector having a production bore and an annulus bore which extend through said bottom end of said EDP and which are in fluid communication with said production bore and said annulus bore of said RSP, said production bore and said annulus bore of said selector forming a juncture with a single bore which extends to a top end of said bore selector, said bore selector having a remotely operable selector device at said juncture for selectively closing off either the selector production bore or the selector annulus bore, a monobore riser conduit extending from a surface vessel to said single bore of said bore selector, said RSP including a crossover conduit with a remotely operable crossover valve therein, said crossover conduit connected to said RSP production bore at a crossover production point and to said RSP annulus bore at a crossover annulus point, a remotely operable annulus isolation valve disposed in said riser safety package annulus bore, said RSP including a production bypass conduit with a remotely operable production bypass valve therein, said production bypass conduit connected at a top position to said RSP production bore at a position which is above said crossover production point, said production bypass conduit having a connection at a bottom position to said RSP production bore at a position which is below said crossover production point, a remotely operable grip/seal tubing ram disposed in said RSP production bore at a position below said connection of said top position of said production bypass conduit and at a position above said crossover production point, a remotely operable blind ram disposed in said RSP production bore at a position which is between said RSP production bypass bottom position connection and said crossover production point, and wherein, said blind ram in said RSP production bore is closed, said production bypass valve in said production bypass conduit is closed, said annulus isolation valve in said RSP annulus bore is open, said crossover valve in said RSP is closed, and said selector device is operated such that said selector production bore is closed and said selector annulus bore is open, whereby said annulus is vented through said monobore riser to said vessel.

3. In combination with a subsea well head landing means for landing a tubing hanger carried by said well head, a tubing hanger in said well head having an annulus bore and a production bore and landed in said landing means, and a subsea xmas tree with remotely operable xmas tree valves and having an annulus bore and a production bore which communicate with said annulus bore and said production bore of said tubing hanger, a completion/intervention/riser arrangement comprising, a Riser Safety Package (RSP) having a production bore and an annulus bore which extend from a top end of said RSP to a bottom end of said RSP with said bottom end of said RSP coupled to said subsea xmas tree with said RSP production bore and annulus bore being in communication with said xmas tree production bore and annulus bore, an Emergency Disconnect Package (EDP) having a bottom end and a top end, with said bottom end of said EDP coupled to said top end of said RSP, said EDP incorporating a bore selector having a production bore and an annulus bore which extend through said bottom end of said EDP and which are in fluid communication with said production bore and said annulus bore of said RSP, said production bore and said annulus bore of said selector forming a juncture with a single bore which extends to a top end of said bore selector, said bore selector having a remotely operable selector device at said juncture for selectively closing off either the selector production bore or the selector annulus bore, a monobore riser conduit extending from a surface vessel to said single bore of said bore selector, said RSP including a crossover conduit with a remotely operable crossover valve therein, said crossover conduit connected between said RSP production bore at a crossover production point and to said RSP package annulus bore at a crossover annulus point, a remotely operable annulus isolation valve disposed in said riser safety package annulus bore, said RSP including a production bypass conduit with a remotely operable production bypass valve therein, said production bypass conduit connected at a top position to said RSP production bore at a position which is above said crossover production point, said production bypass conduit having a connection at a bottom position to said RSP production bore at a position which is below said crossover production point, a remotely operable grip/seal tubing ram disposed in said RSP production bore at a position below said connection of said top of said production bypass conduit and at a position above said crossover production point, a remotely operable blind ram disposed in said production bore of said RSP at a position which is between said RSP production bypass bottom position and said production point, and a string of tubing extending from said surface vessel through said monobore riser, said string of tubing having a bottom end positioned at said blind ram of said production bore of said RSP.

4. The completion/intervention riser arrangement of claim 3 wherein, said crossover valve is closed, said annulus isolation valve is closed, and said blind ram is closed, and further comprising, means for pumping circulation fluid down said string of tubing and back up an annulus between said monobore riser conduit and said string of tubing, whereby said monobore riser is cleared of undesirable fluids in preparation for a controlled disconnect of said RSP, EDP, and monobore riser from said subsea xmas tree.

5. The completion/intervention riser arrangement of claim 3 wherein, said grip/seal tubing ram is closed about said string of tubing which has its bottom end positioned at said blind ram, said xmas tree valves are closed, said crossover valve is closed, said RSP annulus isolation valve is open, and further comprising, means for pumping circulation fluid down said string of tubing, whereby circulation fluid passes through said crossover conduit, up said RSP annulus bore and into an annulus between said string of tubing and said monobore riser conduit to said surface vessel, whereby said monobore riser can be cleared of undesired fluid during controlled disconnect of said RSP, EDP, and monobore riser from said subsea xmas tree.

6. The completion intervention system of claim 3 wherein, said annulus isolation valve is closed, said blind ram is closed, said grip and seal tubing ram is closed about said string of tubing, said crossover valve in said crossover conduit is open, and, said production bypass valve in said production bypass conduit is open, and further comprising, means for providing communication between said production and annulus bores from within said well below said tubing hanger, whereby well fluids can be circulated between said surface vessel and said well via a path down said string of tubing, through said cross over conduit, down the annulus bore into said well, up the production bore, through said production bypass conduit and back to said surface vessel via an annulus between said monobore riser conduit and said string of tubing.

7. In combination with a subsea well head, landing means for landing a tubing hanger carried by said well head, a tubing hanger in said well head having an annulus bore and a production bore and landed in said landing means, and a subsea xmas tree having an annulus bore and a production bore which communicate with said annulus bore and said production bore of said tubing hanger, a completion/intervention/riser arrangement comprising, a Riser Safety Package (RSP) having a production bore and an annulus bore which extend from a top end of said RSP to a bottom end of said RSP with said bottom end of said RSP coupled to said subsea xmas tree with said RSP production bore and annulus bore being in communication with said xmas tree production bore and annulus bore, an Emergency Disconnect Package (EDP) having a bottom end and a top end, with said bottom end of said EDP coupled to said top end of said RSP, said EDP including a bore selector having a production bore and an annulus bore which extend through said bottom end of said EDP and which are in fluid communication with said production bore and said annulus bore of said RSP, said production bore and said annulus bore of said selector forming a juncture with a single bore which extends to a top end of said bore selector, said bore selector having a remotely operable selector device at said juncture for selectively closing off either the selector production bore or the selector annulus bore, a monobore riser conduit extending from a surface vessel to said single bore of said bore selector, said RSP including a crossover conduit with a remotely operable crossover valve therein, said crossover conduit connected between said RSP production bore at a crossover production point and to said RSP annulus bore at a crossover annulus point, a remotely operable annulus isolation valve disposed in said RSP annulus bore, said RSP including a production bypass conduit with a remotely operable production bypass valve therein, said production bypass conduit connected at a top position to said RSP production bore at a position which is above said crossover production point, said production bypass conduit having a connection at a bottom position to said RSP production bore at a position which is below said crossover production point, a remotely operable grip/seal tubing ram disposed in said RSP production bore at a position below said connection of said top of said production bypass conduit and at a position above said crossover production point, a remotely operable blind ram disposed in said production bore of said RSP at a position which is between said RSP production bypass bottom position connection and said crossover production point, a remotely operable retainer valve disposed in said single bore of said bore selector which extends to said top end of said bore selector, a string of tubing extending from said surface vessel through said monobore riser, said string of tubing having a bottom end positioned above said retainer valve of said bore selector, and wherein, said retainer valve is closed, and said annulus isolation valve, said crossover valve, said lower grip/seal tubing ram, said blind ram, said upper grip/seal tubing ram and said production bypass valve are closed, and further comprising, means for pumping circulation fluid down said string of tubing where said circulation fluid is directed by said retainer valve back up an annulus between said monobore riser and said string of tubing extending within said monobore riser, whereby said riser may be circulated with desirable fluid upon being disconnected from said RSP and said xmas tree by said EDP.

* * * * *